US005312007A

United States Patent [19]

Kaufhold et al.

[11] Patent Number: 5,312,007

[45] Date of Patent: May 17, 1994

[54] SLACKLESS RAILWAY COUPLER WITH DRAFT/BUFF GEAR

[75] Inventors: Horst T. Kaufhold; John J. Steffen, both of Aurora; David J. Jarvis, Chicago, all of Ill.; David G. Anderson, Chesterton, Ind.; Ronald G. Butler, Mundelein, Ill.

[73] Assignee: AMSTED Industries Incorporated, Chicago, Ill.

[21] Appl. No.: 986,862

[22] Filed: Dec. 4, 1992

[51] Int. Cl.[5] ..... B61G 7/10

[52] U.S. Cl. ..... 213/75 R; 213/50; 213/62 R; 213/62 A

[58] Field of Search ..... 213/10, 50, 53, 59, 213/61, 62 R, 62 A, 67, 67 R, 69, 75 R

[56] References Cited

U.S. PATENT DOCUMENTS

| | | | |
|---|---|---|---|
| 2,318,472 | 5/1943 | Dwyer, Jr. et al. | 213/59 X |
| 2,880,888 | 4/1959 | Blattner | 213/64 |
| 3,716,146 | 2/1973 | Altherr | 213/64 X |
| 4,258,628 | 3/1981 | Altherr | 213/75 R X |
| 4,531,648 | 7/1985 | Paton | 213/59 X |
| 4,593,827 | 6/1986 | Altherr | 213/62 R X |
| 4,700,853 | 10/1987 | Altherr et al. | 213/62 R X |
| 5,131,548 | 7/1992 | Chi | 213/67 R X |

FOREIGN PATENT DOCUMENTS

| | | | |
|---|---|---|---|
| 1258258 | 8/1989 | Canada | 213/61 |

*Primary Examiner*—Douglas C. Butler
*Assistant Examiner*—Joseph Morano
*Attorney, Agent, or Firm*—Edward J. Brosius; F. S. Gregorczyk; Thomas J. Schab

[57] ABSTRACT

A slackless railcar coupler assembly, which is mountable in a railcar center sill, has a draft gear subassembly operable against a rear stop, and a slackfree coupler apparatus mounted in a coupler pocket forward of said draft gear subassembly, which subassembly and apparatus are connected to provide a dynamic load in both the buff and draft directions to avoid a mechanical, longitudinal stress load on the coupler assembly and railway car.

5 Claims, 4 Drawing Sheets

SLACKLESS RAILWAY COUPLER WITH DRAFT/BUFF GEAR

BACKGROUND OF THE INVENTION

The present invention provides a railway car coupler or connector with a buff/draft gear assembly. More particularly, the invention relates to a slackless drawbar connector with an integral assembly to cushion the dynamic loading of the slackless connector in both the buff and draft directions of the coupled railcars.

The rail industry developed with the steam locomotive, which is a lower torque drive means than the modern diesel locomotive. The steam locomotive did not have the torque capacity to initiate drive on the full length of a train of tightly coupled cars, therefore, a degree of free-travel or free-play between cars was required to allow sequential initiation of car travel of loaded trains. The coupling apparatus between the cars had to not only accommodate the longitudinal travel in both directions, but also had the vertical and horizontal travel at the coupling as the train progressed along the rails. In addition, couplers are generally assembled from as-cast components, which do not have the dimensional tolerances associated with machined elements. Therefore, all the free play and relative loose connections associated with earlier couplers were acceptable conditions, and as noted above, they were necessary conditions.

The diesel locomotive brought about changes in the load-bearing capacity of trains, their physical parameters and in their operating characteristics. The physical and mechanical properties of the couplers joining the individual cars of the train also changed to accommodate the train improvements. The greater loads carried by modern railway trains have changed the perception of the coupler engineer and designer with regard to train operating characteristics. Indicative of this change in perception is that heavier loads are carried on rail cars and the industry has moved to maintain close-butted relationships between coupler draft components to lessen the impact forces on cars, couplers and lading.

Since most coupler drawbar connection parts are cast with little or no finish machining to provide dimensional control, it is desirable to provide a self-adjusting coupling device to accommodate component wear and to lessen the slack in the coupler connections. One type of self-adjusting articulated coupler is shown in U.S. Pat. No. 3,716,146.

In an exemplary slackless drawbar coupling structure, the drawbar extends between the car sill sides and nests in a pocket casting. The butt end of the drawbar may be convexly arcuate and abut a complementary front concave surface of a follower block. The back surface of the follower abuts the front surface of a wedge which has a rear surface abutting the rear wall of the pocket casting within the car sill. Either or both of the front and rear surfaces of the wedge member diverge upwardly to yield a gravity-assisted wedging force, which provides the slackless coupling arrangement. When the abutting surfaces become worn, the wedge member drops slightly to maintain the essentially slackless connection.

The top, bottom and vertically disposed side walls in the pocket casting of the drawbar coupling arrangement provide a cavity for the follower and the wedge. Upon horizontal angling of the drawbar, the side walls limit the lateral translation and, therefore, the rotation of the follower about the vertical axis of the arcuate butt end of the drawbar. Rotation of the follower may potentially cause the wedge to rotate about the car longitudinal axis and possibly hang up between the vertical walls, especially when the wedge is small in height relative to its width. A method of controlling rotation of the follower, and the relative orientation between the wedge and the follower provides for a very close tolerance between the vertical side walls of the cavity and the wedge and the follower side edges. As these are cast components, the procedure providing close tolerances between components requires an uneconomical amount of tolerance design and machining of finished parts.

The term slackless means that the drawbar (or coupler) is received within the center sill in a manner to minimize longitudinal play or movement. However, because successive railway cars in a train must accommodate relative movement between cars, when curves and inclines are negotiated, there must be a provision for each car to move in pitch, yaw and roll modes with respect to the coupler member. Moreover, there must also be a provision to remove the draft components for repair and replacement of parts and, to disconnect coupled cars.

In a slackless system, the coupler member is held in a manner to eliminate, or minimize, longitudinal movement with respect to the car body. As noted above, this may be done by providing a tapered wedge between a rear wall of a pocket casting (secured in the center sill) and a follower block which rests against the butt end of the coupler member. The wedge tends to force the follower block away from the pocket casting end wall and firmly against the butt end of the coupler member shank. In railway cars being pushed, the longitudinal forces cause compression of the coupler member against the follower, wedge and pocket end wall of the slackless arrangement.

When cars are being pulled, the longitudinal forces tending to separate the drawbar from the pocket casting are countered by a draft key or connecting pin, which is a metal bar extending laterally or vertically of the center sill and a slot or pin bore in the shank of the coupler member. In a slackless drawbar system, the drawbar is held tightly between the pin or key bearing block (with the connecting pin or draft key) and follower block by the wedge separating the pocket casting and follower block, which wedge compresses the follower block against the butt end of the drawbar. However, the mating faces of the follower block and drawbar are preferably curved to permit the drawbar to pivot, both vertically and laterally, and to permit the car to roll with respect to the drawbar. The drawbar also pivots at the draft key or pin connection on an arcuate pin or key bearing block interposed between the parts.

In U.S. Pat. No. 4,593,827 to Altherr, a slackless coupler is shown with the drawbar extending into the car center sill. The front surface of a follower block in the center sill has an arcuate concave section abutting the convex arcuate end of the drawbar. The follower block rear surface has a convex shape of two generally planar surfaces joined at a vertex substantially in the vertical centerplane of the car. The wedge shim is provided with a generally concave surface, which complementarily abuts the convex surface of the follower block. The interrelationship of the shim and block surfaces maintains the orientation of the assembly and inhibits lateral translation between the shim, the follower and the side casting.

U.S. Pat. No. 4,700,853 to Altherr et al. also provides a slackless coupler with the placement of contoured spacer means within the center sill on either side of the coupler member, both above and below the draft key slots, to prevent lateral movement of the drawbar on the draft key. A preferred embodiment also includes access means or ports in the pocket casting for engagement or withdrawal of the wedge from contact with the follower blocks.

Draft gear assemblies have been known and utilized for coupler systems in the prior art, however, they frequently utilized large spring assemblies, which added to the weight of the undercarriage assembly and detracted from the freight carrying capacity of the railway car. Illustrative examples of draft gear assemblies operable to absorb buff and draft forces applied to the draft gear are shown in CAR AND LOCOMOTIVE CYCLOPEDIA, CENTENNIAL EDITION (1974), at page S9–s32. Force diagrams, which illustrate the effect of impact forces on a cushioning device from both directions along the longitudinal axis of the assembly, are noted in some of the figures. As with most known draft gear assemblies, the intent of these assemblies is generally to protect the freight car structure. Lading protection, however, requires varying degrees of energy dissipation. Sliding sill arrangements to accommodate lading protection are generally complicated assemblies with attendant higher assembly costs. Therefore, end-of-car cushioning devices evolved, which units could be installed outboard of the car bolsters, but do not fit within the standard draft gear pockets. These cushioning units have both greater travel and greater energy absorbing ability than convential draft gears. The American Association of Railroads, A.A.R., specifications for Special Cushioning Devices for Freight Cars are delineated at A.A.R. specification number M-921-65, and include impact testing, appraisal under actual service conditions and service experience.

Buff gears or buff gear assemblies are also known and utilized in railroad car couplers to form a compression spring assembly. These buff or draft gear assemblies are typically used between railway cars to buffer the impact of adjacent cars, and to compensate for the impact loads on the car couplers during operation of the train. A buff gear arrangement is illustrated in U.S. Pat. No. 4,556,678 to D. G. Anderson and includes a mounting assembly for positioning the cushioning apparatus in the coupler assembly. The buffer operates to absorb the force load from the impact between adjacent cars in a freight train, which may occur during humping of freight cars. However, the utilization of these buff/draft gear assemblies has not been feasible with slackless couplers, as these couplers had to be operable in both the draft and buff directions with little or no longitudinal freeplay in the coupler assembly.

SUMMARY OF THE INVENTION

The present invention provides a shock-absorbing, dynamically-loaded, buff/draft gear apparatus to absorb the load on a slackless railroad car coupler in both the buff and draft directions of travel, which dual-direction apparatus is not presently available with standard slackless couplers. The buff/draft gear structure avoids shock-loading from sudden acceleration in the draft direction for slackless or slackfree couplers, while retaining the shock-loading or shock-absorbing capability of the assembly in the buff direction, especially for freight cars being humped. This buff/draft gear apparatus is operable with the slackfree couplers, which are not the articulated type of connectors, without dramatic changes in the center sill or other mechanical structure of the assembly. The buff/draft gear structure is not prohibitively large, which minimizes the space requirements, and it is also adaptable to existing railroad car center sills with draft gear assemblies. The buff/draft gear structure makes the utilization of extant slackless subassemblies adaptable for incorporation into the shock-absorbing apparatus, and provides a variable load absorbing potential based upon design criteria for each particular railroad car and coupler. This latter variation in shock-absorbing capacity is accommodated by the addition of more or fewer of the axially arranged friction pads in the load-absorbing elements.

Both the slackless coupler and the buff/draft gear assembly have individually been provided in couplers. However, the utilization of the slackless coupler has less free travel to accommodate the draft-direction coupler loading. Therefore, concern about knuckle or coupler wear and damage in a slackless coupler from the short travel shock load in the draft direction is alleviated by the present invention as the load is transferred to a center front-stop, while permitting adaption of the buff/draft gear to absorb the compressive load in the buff direction.

BRIEF DESCRIPTION OF THE DRAWING

In the figures of the drawing like reference numerals identify like components, and in the drawings:

FIG. 6(*a*) is an elevational view of the front-stops in FIG. 5;

DETAILED DESCRIPTION OF THE INVENTION

Figure 1:
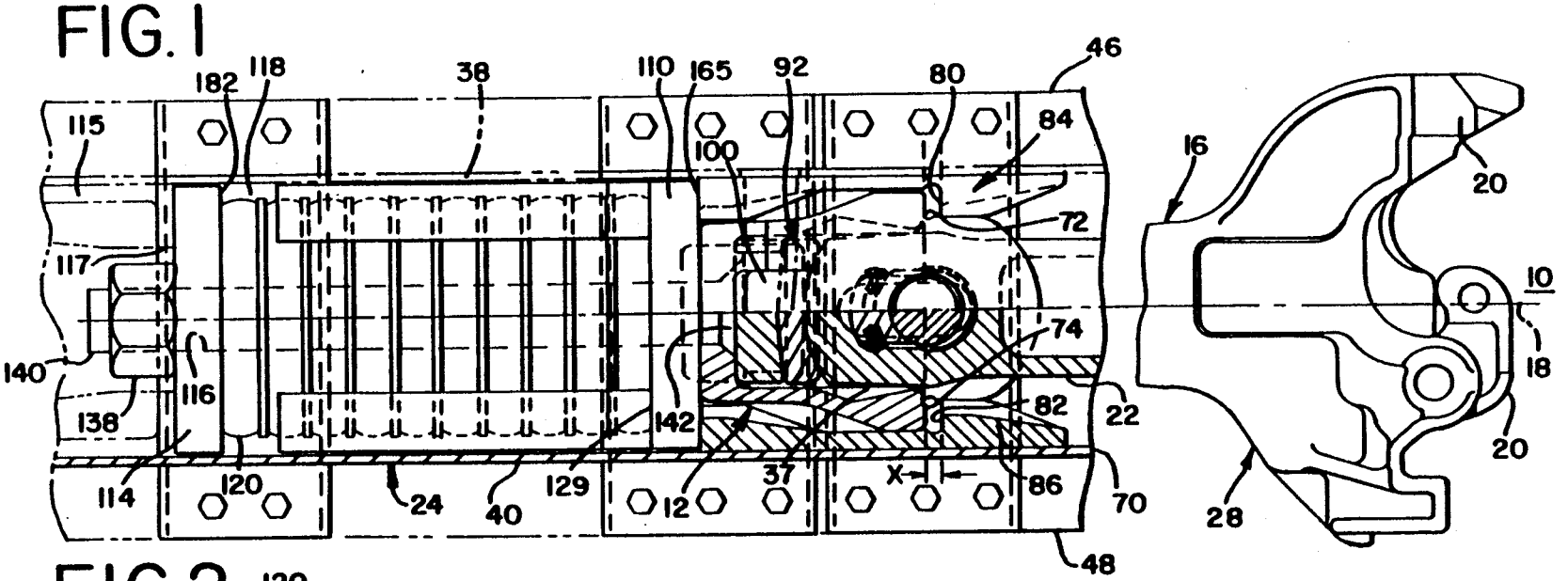
FIG. 1 is a plan view of the slackfree coupler and draft/buff gear assembly in partial cross-section.
Figure 2:
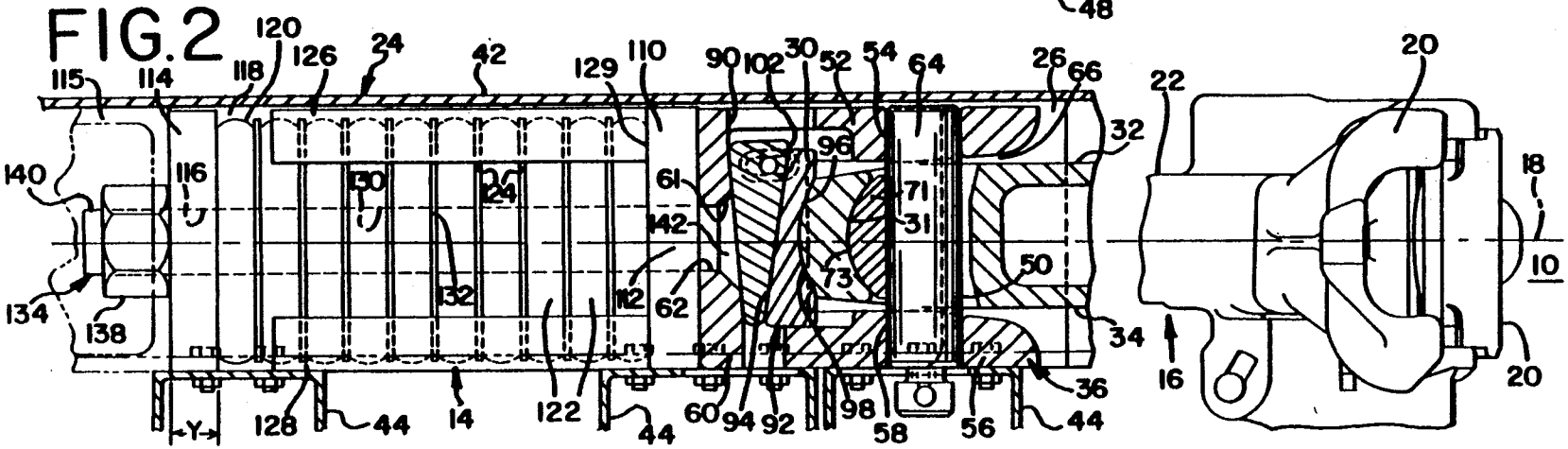
FIG. 2 is an elevational view of the slackfree coupler and draft/buff gear assembly in cross-section.

A railway car standard coupler assembly 10 in FIGS. 1 and 2 has a slackfree apparatus 12 to minimize free play in coupler assembly 10, and a buff/draft gear apparatus 14 to accommodate dynamic shock loading of coupler 16 in both the buff and draft directions of travel along coupler-arm longitudinal axis 18. Coupler arm 22 extends along axis 18 from knuckle 20 into pocket 26 of center sill 24. Knuckle 20 is matable with a similar or mating member protruding from a second railway car or locomotive to connect the cars for travel along railway tracks, which railway cars and tracks are not shown, but are known in the art.

Slackfree coupler apparatus 12 minimizes the free travel of coupler 16 in the draft direction of railway car travel through automatic adjustment of apparatus 12. More specifically, arm 22 has forward end 28 connected to knuckle 20, and a rear or butt end 30 with an arcuate shape in the horizontal direction. Upper surface 32 and lower surface 34 of arm 22 are generally planar, however, their specific shape is not a limitation to the present invention. Arm 22 and particularly its butt end 30 extend into pocket casting 36 mounted in center sill pocket 26. Center sill 24 has first sidewall 38, second sidewall 40 and top wall 42 in FIG. 2, which cooperate to provide center-sill pocket 26. At least one support 44 extends across lower edges 46 and 48 of first and second sidewalls 38 and 40 to provide an essentially closed pocket 26 in center sill 24 to receive draft/buff gear 14 and coupler arm 22.

In FIG. 2, arm 22 at butt end 30 has a vertical connecting-pin bore 50, which is transverse to axis 18 in this figure and about normal to upper surface 32 and lower surface 34. Pocket casting 36 is connected to buff/draft gear apparatus 14 and arm 22 to provide a slidable connection between these components. Pocket casting 36 with chamber 37 has upper wall 52 with first passage 54 and lower wall 56 with second passage 58, which passages 54 and 58 are aligned. Rear wall 60 of casting 36, as shown in FIGS. 1–4, has an aperture 62 generally centrally aligned with axis 18. Pocket casting 36 is slidably positioned in center-sill pocket 26 to receive rear portion of arm 22 in pocket-casting chamber 37. Passages 54 and 58 are alienable with pin bore 50 for receipt of vertical connecting pin 64, and connection of coupler 16 with center sill 24 for rotation of arm 22 about pin 64. Further, upper and lower walls 52 and 56 have inner wall surfaces 66,68, respectively, which slope or are tapered outwardly essentially from passages 54,58 to the open end 70 of center sill 24. A pin-bearing block 71 with a curved surface 73, as shown in FIG. 2, is interposed between connecting pin 64 and the concave spherical inner surface 31 of arm opening or bore 50, which pin-bearing block 71 is operable to provide smooth rotation between pin 64 and concave inner surface 31 of opening 50 during draft travel of coupler 22.

Pocket casting 36 in the illustrated reference postion of FIGS. 1 and 2 is slidable in cavity 26 along axis 18. However, its travel in the draft direction is limited by contact of front surfaces 72 and 74 of pocket-casting tongues 76 and 78, respectively, with protruding lips 80, 82 of respective front-stops 84, 86. Front-stops 84, 86 with lips 80, 82, respectively, to limit the forward or draft motion of casting 36 provide parallel sliding guides for pocket casting 36, which front-stops 84,86 are secured in position in center-sill cavity 26 to respective walls 38 and 40. Castings 84 and 86 are contoured and shaped to minimize their weight, while maintaining operability and adequate mechanical strength for the application.

Figure 3:
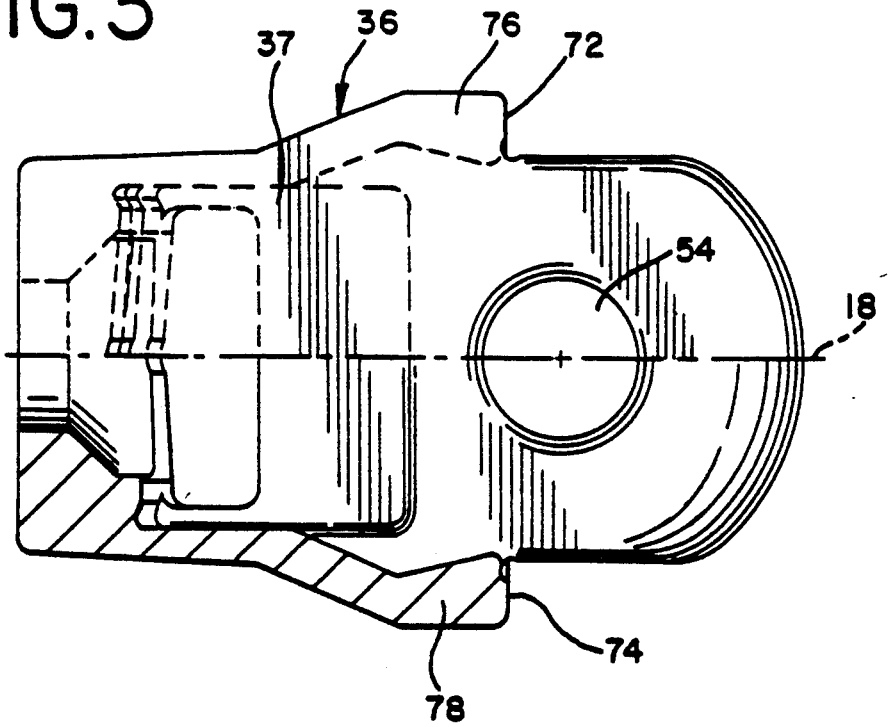
FIG. 3 is a plan view of a short yoke with an integral pocket casting in partial cross-section.
Figure 4:
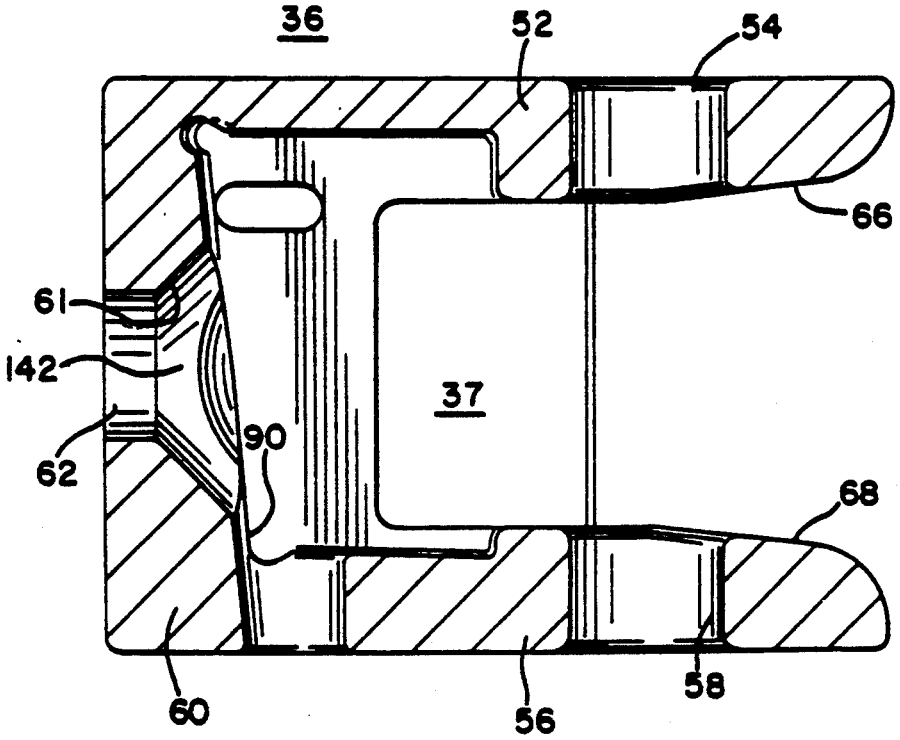
FIG. 4 is an elevational view of the pocket casting of FIG. 3 in cross-section.
Figure 5:
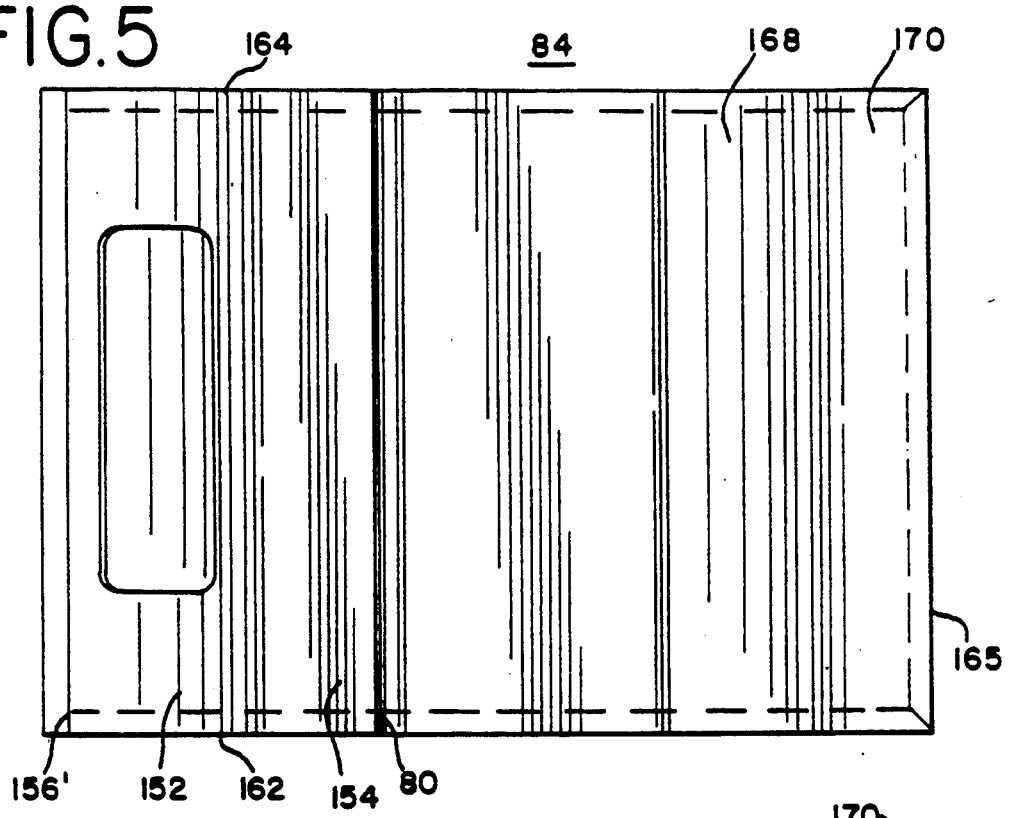
FIG. 5 is a plan view of the front-stops in FIG. 1.

In the illustrated embodiment of pocket casting 36 shown in FIGS. 3 and 4, forward surface 90 of rear wall 60 is tapered from upper wall 52 to lower wall 56 to accommodate a preferred embodiment of slackless adjustment apparatus 12. The slope of the illustrated taper implies a more narrow section of wall 60 at upper wall 52, and a wider section of wall 60 at lower wall 56. The particular style of slackless adjustment apparatus is not a limitation to the present invention.

Figure 6A:
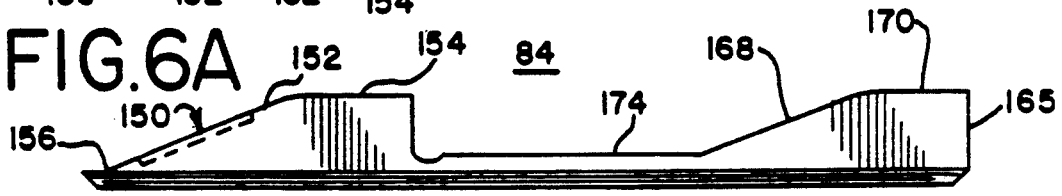
FIG. 6 is an oblique view of the front-stops in FIG. 5.
Figure 6:
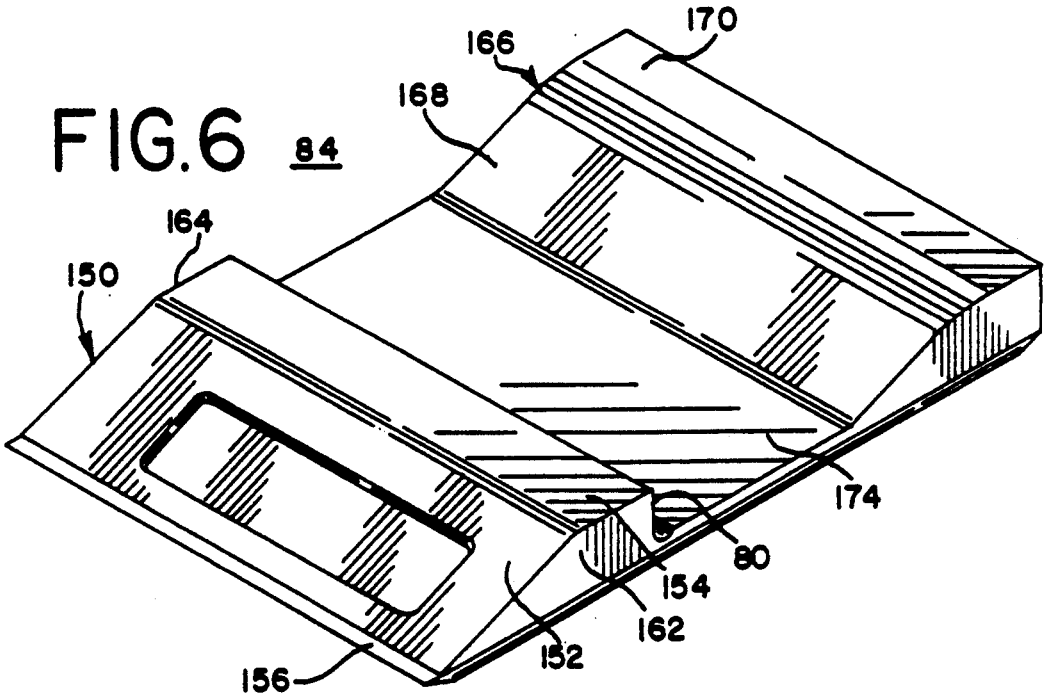
Figure 7:
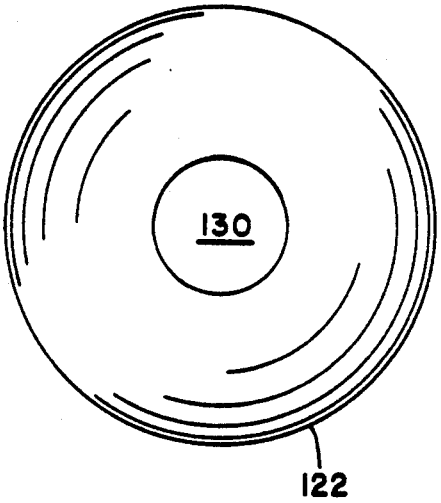
FIG. 7 is a plan view of an annular-shaped elastomer body or pad for use as a load absorbing element in a draft/buff gear assembly.

An enlarged illustration of a cast front-stop 84 is provided in FIG. 6 and 6A, and it is appreciated that casting 86 is a similar structure, thus only front-stop casting 84 will be described. As noted in the figure, casting 84 has a forward sloped or ramped frame 150 with front face or lip 80 and ramp 152 tapering downward from upper surface 154 to front edge 156. A second ramped frame or rear draft stop 166 is provided at the back portion of front-stop 84 with forward sloping ramp 168 extending from upper surface 170 and a rear stop face 165. First and second ramp frames 150, 166, respectively, are separated by valley 174 for receipt of a protruding lip or tongue 76, 78 of pocket casting 36, which allows sliding contact to front surfaces 80 and 82 on respective front-stops 84, 86.

Slackfree or slackless coupler apparatus 12 is operable to minimize the free slack of coupler arm 22 along longitudinal axis 18. In the illustrated embodiment of FIGS. 1 and 2, slackfree coupler apparatus 12 includes follower 92 with a downwardly tapered rear surface 94 and a concave, spherically curved, forward surface 96 for mating engagement with convex, spherical butt surface 98 of coupler arm 22, which tapered surface 94 provides a wider cross-section at the lower portion than the upper cross-section of follower 92 in this figure. Wedge 100 of slackless apparatus 12 has a generally rectangular cross-section with a wider upper cross-section than its lower cross-section. Wedge 100 is interposed between follower 92 and rear wall 60 in chamber 37 with tapered forward face 102 slidingly contacting rear face 94 of follower 92. In this configuration, wedge 100 is operable to move downward, as the coupler elements wear, to accommodate any change in their dimensions and maintain the relative slackless condition, that is minimal longitudinal motion, of coupler arm 22 and assembly 10. This general structure and operation of slackless apparatus 12 is a rather generic description of a slackless apparatus, however, the specific arrangement or component structure is not a limitation to the operation and assembly of the present invention.

Front gear plate 110 of buff/draft gear apparatus 14 with generally central throughport 112 is slidably positioned in center-sill passage 26 contacting rear draft-stop faces 165 of front stops 84 and 86. Rear gear plate 114 with central throughport 116 is positioned and secured in center-sill passage 26 contacting rear positive stop 115, which front and rear gear plates 110 and 114, and center sill 24 provide draft gear enclosure 118 within chamber 26. Rear positive stop 115 is secured to center sill sidewalls 38 and 40 by means known in the art, and includes a generally centrally positioned throughbore 117 in FIG. 1.

Buff/draft apparatus 14 has draft gear 120, which is composed of a plurality of elastomeric segments 122 each separated from an adjacent segment 122 by a divider plate 124, positioned and operable in enclosure 118 to provide a shock-absorbing or dynamically loaded arrangement of coupler assembly 10. Guide bars 126 and 128 extend from rear surface 129 of front gear plate 110, which guide bars are operable to provide a positive stop between front gear plate 110 and rear gear plate 114 at compression of the elastomer elements 122 from buff loading of coupler assembly 10.

Figure 8:
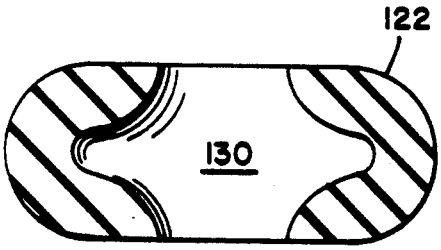
FIG. 8 is an elevational cross-section of the elastomer body in FIG. 7, which has been compressed under a load; and, FIG. 9 is a plan view in cross-section of a plurality of elastomer members axially aligned in a chamber.
Figure 9:
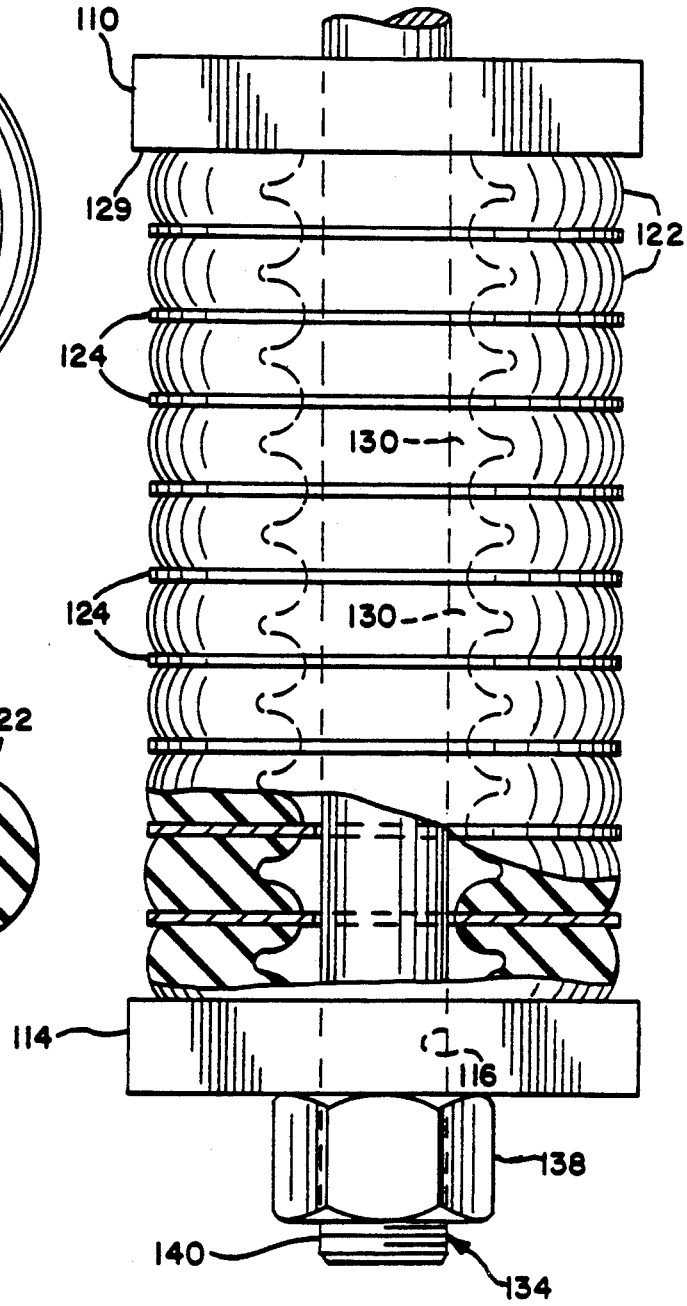

Each of elastomeric segments 122 and dividers 124 have a generally centrally positioned passage or aperture 130, 132, respectively, to receive a connecting rod or element 134 extending through pocket-casting port 62, forward plate passage 112, rear plate passage 116 as well as the noted passages 130, 132. Rod 134 is illustrated as a bolt with its head 142 nested in a counterbore 61 at the forward surface 90 of pocket-casting rear wall 60 and secured against the rear wall of rear gear plate 114 by nut 138 on threaded bolt end 140, which nut 138 is sized to pass through throughbore 117 of rear positive stops 115. Nesting of bolt head 142 in counterbore 61 provides a smooth surface along front face 90 of pocket casting rear wall 60, which allows freedom of movement for wedge 100 of slackless apparatus 12. The effect of a compressive load on elastomeric elements 122 is illustrated in FIGS. 8 and 9, where the deformation of passages 130 is demonstrated. The structure of FIG. 9 is a known embodiment of a draft gear assembly for absorbing buff forces in a coupler assembly, such as coupler assembly 10.

Draft gear assembly 14 and slackfree apparatus 12 are both operable in standard operating modes as individual components. In these modes, slackfree apparatus 12 is operable to continuously adjust coupler 10 and arm 22 to maintain a cushioning slack or no slack condition. As noted above, the term slackless or slackfree is indicative of a very limited amount of free play between the several components of a railway car coupling connection. At assembly of coupler 10, elastomeric elements 122 are slightly compressed to provide a dynamic load to assembly 10 at the reference position, which dynamic load allows the draft gear 14 to absorb the shock load at initiation of railcar motion in the draft direction. There is a small separation distance, 'x', which is illustrated in FIG. 1, between front-stop surface 82 and pocket-casting tongue front surface 74, and a similar separation is noted at opposed front-stop 84. This separation accounts for the cushioned slack provided by the precompressed draft/buff gear. In the illustrated reference position of the coupler components noted in FIGS. 1 and 2, connecting pin 64 is provided in contact with block 71, which is the usual position of a coupler assembly during draft direction of travel of a railcar.

In the buff direction, that is coupler movement to the left in FIGS. 1 and 2, coupler arm 22 moves pocket-casting 36 with slackless apparatus 12, as well as front gear plate 110 with guide bars 126 and 128 to compress elastomeric elements 122 for absorption of the compressive forces from the railcar or locomotive, especially those forces experienced during humping of railcars in a classification yard. The limit of travel of draft gear 12 and pocket casting 36 in the buff direction is fixed by the separation distance 'y' between guide bars 126, 128 and rear gear plate forward surface 182. This also limits the energy absorbed by draft gear 14, as no further compression of elastomeric elements 122 may occur.

The limits of travel of the slackfree/draft-gear structure in coupler 10 are thus fixed in the draft direction by separation distance 'x', which couples pocket casting 36 with side-sill castings 84, 86 and thereby connects center sill 24 with arm 22, knuckle 20 and the coupled railcars. All the mechanical forces are, therefore, almost immediately transferred to front-stop castings 84, 86 and, thus, center sill 24, as separation distance 'x' is generally about three-quarter (0.75) inch, which is generally related to the "slackless" condition in railway car couplers. The draft gear apparatus is operable to absorb the shock load associated with railcar travel in the buff direction. In the illustration of FIGS. 1 and 2, the separation distance is about one and one-quarter (1.25) inches, but the limit of travel between front gear plate 110 and rear gear plate 114 is provided by guide bars 126, 128. However, the travel distance of pocket casting 36 in the buff direction is not limited by front-stop castings 84, 86, as casting 36 slides parallel to the walls of front-stop castings 84 and 86 during inboard travel in center-sill cavity 26.

While only specific embodiments of the invention have been described and shown, it is apparent that various alterations and modifications can be made therein. It is, therefore, the intention in therefore the appended claims to cover all such modifications and alterations as may fall within the true scope and spirit of the invention.

We claim:

1. An assembly for connecting railway cars, which have a railway-car center sill with a rear positive stop secured to said center sill, a longitudinal axis, and a coupler cavity to receive a coupler mechanism for connecting adjacent railway cars, said assembly comprising:

a pocket casting having an enclosure, a first end, a second end and an aperture at one of said first and second ends for communication through said casting, said pocket casting slidable in said coupler cavity;

at least one sill side casting positioned in said coupler cavity, secured to said center sill and operable to limit sliding movement of said pocket casting in said coupler cavity between buff and draft movements of said shank;

a slack-free coupler having a shank with a butt end and a pin-bearing block;

a mating follower and a wedge mounted in said pocket-casting enclosure against the other of said first and second ends, said shank extending through said pocket-casting aperture to contact said mating follower at said butt-end;

a coupling pin;

said pocket casting defining a first port and a second port, said first and second ports approximately aligned and about transverse to said longitudinal axis;

said shank defining a through-passage with said pin-bearing block positioned therein, which through-passage is alignable with said first and second ports to receive said coupling pin for connecting said shank to said pocket casting;

a draft gear subassembly positioned and operable in said coupler cavity between said slidable pocket casting and said rear positive stop;

means for connecting said pocket casting and draft gear assembly to said rear draft stop to conjoin said slack-free coupler and draft gear subassembly to provide a compressive force preload on said coupler and shank in both the buff and draft directions of railway car travel.

2. In a railway car having a center sill with a forward end, a back end, a coupler pocket and at least one side sill casting with a draft stop in said center sill pocket, an assembly to provide a compressive load on a slackfree apparatus in both the draft and buff directions for a coupler with a coupler arm, a knuckle and a spherical butt end, said coupler mountable in said center sill and operable to be dynamically loaded in both draft and buff directions, said assembly for a coupler comprising:

a draft gear subassembly positioned and operable in said coupler pocket, said subassembly having a front follower plate, a rear follower plate and means for preloading said coupler assembly, which preloading means is positioned between said front and rear follower plates;

a slackfree coupler apparatus mountable in said coupler pocket between said draft gear subassembly and said center sill forward end;

said slackfree coupler apparatus having a forward stop and at least one sill side-casting mounted in said center-sill coupler pocket;

a pocket casting positioned and slidable in said coupler pocket, said pocket casting about aligned with said side-sill castings;

said draft gear subassembly having a front follower plate, a rear follower plate and means for preloading said assembly, which preloading means is positioned between said front and rear follower plates;

means for connecting said slackfree coupler apparatus and draft gear subassembly to provide a first compressive load on said slackfree coupler apparatus in said draft direction and a second compressive load on said coupler apparatus in said buff direction, said connecting means mechanically connecting said pocket casting, front follower plate and rear follower plate for cooperative travel, which provides a dynamic preload in both the buff and draft directions of travel and avoids a mechanical, longitudinal stress load on said coupler assembly and railway car;

said subassembly having at least a first guide bar and a second guide bar cooperating to generally define a sleeve with a first end and a second end, which first and second guide bars are affixed to said front follower plate at one of said first and second ends, the other of said first and second ends separated from said rear follower plate at a predetermined reference distance, said sleeve defining a through-passage; and, means for preloading positioned in said through-passage between said front follower plate and rear follower plate to provide a first preload on said coupler assembly at a reference position, said preloading means compressible by said rear follower plate at a draft load to buffer said coupler assembly during slack travel of said coupler assembly prior to mechanical lockup of said coupler assembly.

3. A railway car coupler assembly as claimed in claim 2 wherein said coupler subassembly comprises:

said pocket casting having a rear wall, an upper wall with a pin throughbore, a first sidearm, a second sidearm and a cavity to receive a mating railcar drawbar;

a wedge and a mating follower positioned and operable in said pocket-casting cavity at said rear wall to maintain said coupler subassembly at a reference position in said cavity;

a connecting-pin matable with said railcar drawbar and said pin throughbore, a side sill casting mounted and operable in said center sill casting for said pocket casting and having a chamber to receive said pocket casting, said sill side-casting nested against said front follower plate at a first end and being open and having at its second end to receive said drawbar, and having a first sidewall and a second sidewall;

a first tab and a second tab at said other sill side casting end projecting into said chamber;

said pocket casting head end displaced from said tabs a predetermined distance, which pocket casting is slidable in said chamber for engagement of said head end with said tabs and against the compressive preload of said draft gear.

4. An assembly for a coupler as claimed in claim 2 wherein said means for preloading has a plurality of elastomeric segments, at least one divider plate between each adjacent pair of said elastomeric segments, each of said elastomeric segments defining an aperture, each of said divider plates defining a passage, said ports and passages alignable to provide a second through-passage;

said pocket casting having a rear wall defining a second aperture;

said front follower plate defining a first throughport;

said rear follower plate defining a second throughport;

said means for connecting has a connecting rod;

a rear positive stop secured in said center sill;

said first and second throughports, and said second through-passage alignable to receive said connecting rod to join said pocket casting, said elastomeric elements, said divider plates, and said front and rear follower plates, said components movement limited between said forward draft stop and said rear positive draft stop.

5. An assembly for a coupler as claimed in claim 4 wherein said elastomeric members are compressible;

said pocket casting having a forward surface and defining a chamber;

said connecting rod having a head contacting said pocket casting forward surface, and a threaded end in proximity to said rear positive stop;

a nut threaded to said threaded end against said rear follower plate to compress said elastomeric members and provide said preload.

* * * * *